United States Patent [19]

Fesmire

[11] 4,451,045

[45] May 29, 1984

[54] STEER OR CALF LEGS PRACTICE ROPING DEVICE

[76] Inventor: Charles E. Fesmire, P.O. Box 619, Helena, Okla. 73741

[21] Appl. No.: 495,309

[22] Filed: May 16, 1983

[51] Int. Cl.[1] ..... F41J 9/00

[52] U.S. Cl. ..... 273/338; 273/359

[58] Field of Search ..... 273/338, 339, 348, 359, 273/369, 370

[56] References Cited

U.S. PATENT DOCUMENTS

| | | | |
|---|---|---|---|
| 3,303,821 | 2/1967 | Harris | 273/359 X |
| 3,711,098 | 1/1973 | McCord | 273/359 X |
| 3,776,553 | 12/1973 | Kelton | 273/339 |
| 3,802,706 | 4/1974 | Hamm | 273/339 |
| 3,947,033 | 3/1976 | Benwett | 373/339 |
| 3,974,799 | 8/1976 | Parsons | 273/359 X |
| 4,136,874 | 1/1979 | McCord | 273/339 |
| 4,266,779 | 5/1981 | English | 273/359 |
| 4,286,788 | 9/1981 | Simington et al. | 273/359 |

*Primary Examiner*—William H. Grieb

*Attorney, Agent, or Firm*—Robert K. Rhea

[57] ABSTRACT

A bovine rear leg action simulating device for roping practice including an upright frame supporting a horizontal top frame in cantilever fashion. Motor driven pulleys, mounted at one end of the top frame, are connected with a rock shaft supported by the other end of the top frame for pivoting bovine rear leg simulating arms depending from the rock shaft through an arc of predetermined magnitude.

5 Claims, 1 Drawing Figure

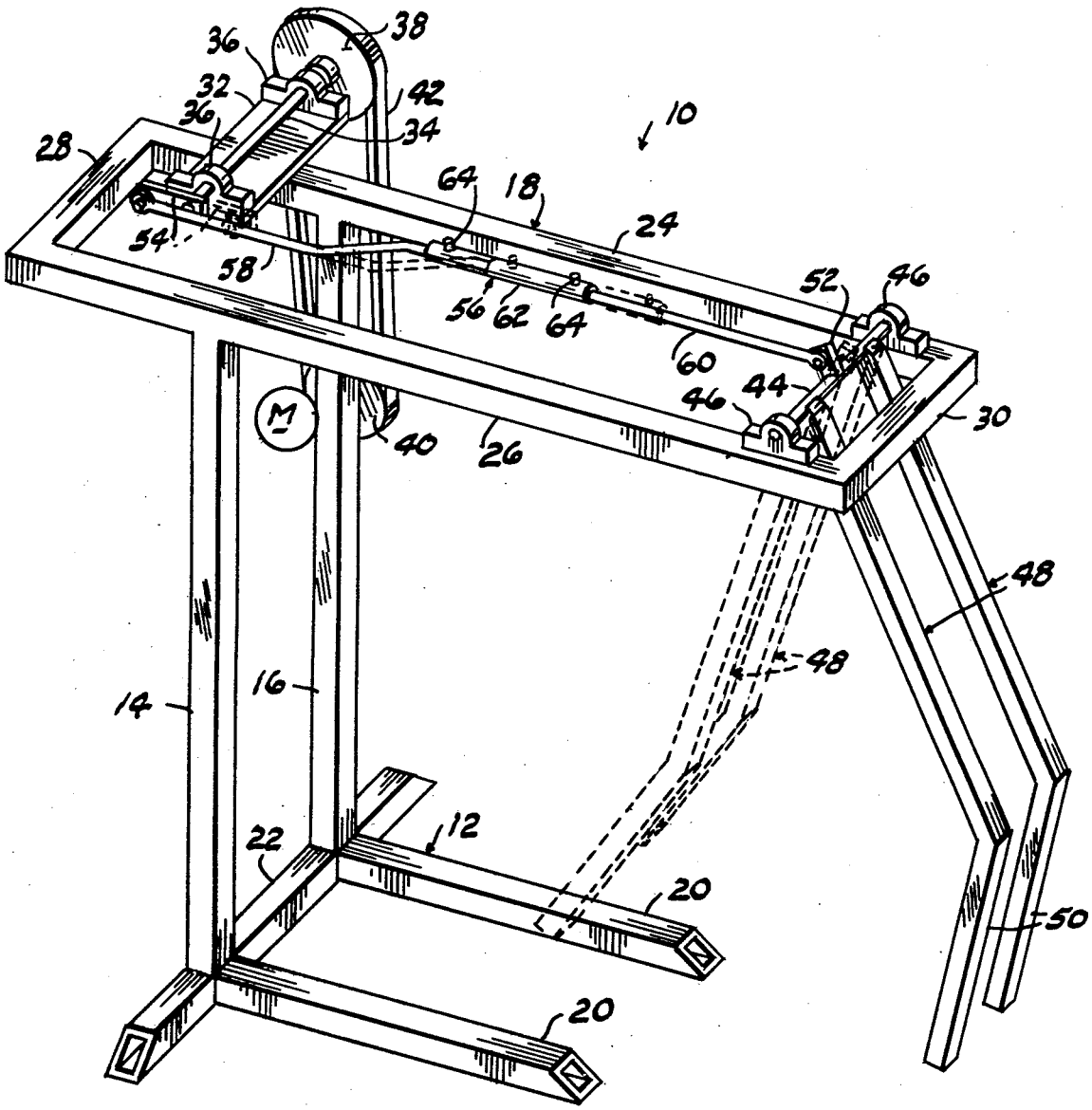
10
12
14
16
18
20
20
22
24
26
28
30
32
34
36
36
38
40
42
44
46
46
48
48
50
52
54
56
58
60
62
64
64
M

STEER OR CALF LEGS PRACTICE ROPING DEVICE

BACKGROUND OF THE INVENTION

1. Field of the Invention

The present invention relates to rodeo training and more particularly to an animal rear leg simulating practice roping device.

Steer roping is a rodeo event in which a steer is released from a chute at one side of an arena and usually runs toward the opposite side of the arena. A pair of mounted ropers, a header and heeler, after a selected interval, follow the steer. The header lassos the steer's head and tows the steer generally toward the left, the heeler then lassos the hind legs of the steer and the ropers turn their horses in opposite directions causing the steer to drop and become immobile. The roping team with the shortest time interval between the release of the steer from the chute and its immobilization is the winner of prise money. Considerable skill and practice, both for the riders and horses, is necessary to become proficient in the steer roping event. Such practice is best accomplished by repeatedly pursuing and roping live animals, however, this is impractical for a number of reasons, for example, the steer or steers must be corralled and cared for. The principal disadvantage of using live animals is the stress induced upon the animals materially effecting their weight gain and subsequent marketable condition.

Roping the steer's head is relatively easily accomplished but roping both legs of a steer usually requires more practice than roping the head.

It is, therefore, desirable that some practice roping device be provided for mounted ropers to practice the technic of roping the rear legs.

2. Description of the Prior Art

Prior patents generally disclose animal simulating devices including at least the head and rear legs which are arranged for mobility and towed along a selected path by a mechanical means or pulled by a mounted rider, however, these devices have not come into general use, principally for the reason, it is believed, that considerable mechanism is required to achieve the desired function and, therefore, are relatively expensive in installation and maintenance.

U.S. Pat. No. 4,136,874 is an example of such prior patents which discloses a horned steer simulating body mounted on a sled runner-like support to be towed across the surface of the earth. A pair of ground engaging wheels, included in its support, changes the height and position of the simulated steer through linkage which also moves a pair of straight bars simulating rear legs for heeling practice.

This invention is distinctive over this and other patents by providing an upright generally open framework having a cantilever end portion supporting a pair of steer leg simulating arms continuously moved forwardly and rearwardly for heeling practice roping.

SUMMARY OF THE INVENTION

An upright open framework, including a base having upright standards, supports a horizontal frame in cantilever fashion. One of the standards supports a variable speed gear train equipped motor drivably connected by belt and pulley means with a pulley drive shaft journalled by one end portion of the horizontal frame overlying the standards. The other end portion of the horizontal frame overhanging the base transversely supports a rock shaft having a pair of steer rear legs simulating arms depending therefrom inwardly of the frame sides. An elongated longitudinally adjustable connecting rod is connected at one end by a cam plate with one end of the pulley drive shaft and connected at its other end with the rock shaft for imparting vertical pivoting movement of the steer leg simulating arms through a selected arc longitudinally of the horizontal frame to simulate the forward and rearward movement of the rear legs of a running steer.

The principal objects of this invention are to provide an economical steer leg practice roping device, easily movable from one location to another, which may be used by one or more mounted ropers and in which the magnitude and rate of movement of the steer legs may be selectively adjusted.

BRIEF DESCRIPTION OF THE DRAWING

The single FIGURE is an isometric view illustrating, by solid and dotted lines, movement of the steer rear leg simulating arms.

DESCRIPTION OF THE PREFERRED EMBODIMENT

Like characters of reference designate like parts in those figures of the drawings in which they occur.

The reference numeral 10 indicates the device, as a whole, which is rectangular upright open framework in general configuration. The device comprises a base frame 12, spaced-apart upright standards 14 and 16 supporting a horizontal frame 18 with one end portion overhanging the base frame. In the example shown, the frames and standards are formed from tubular material, square in cross section, but obviously may be formed from other rod-like rigid material, if desired.

The base frame 12 is generally U-shaped defined by a pair of horizontal legs 20 interconnected in spaced relation by a bight portion 22 projecting beyond the outer limit of the legs 20 to increase the lateral stability of the device. The standards 14 and 16 are secured at their depending ends with the base frame at the juncture of the legs 20 with the bight portion 22. The top frame 18 is elongated rectangular in configuration defined by parallel side rails 24 and 26, each secured at one end portion to the upper limit of the respective standard and interconnected at their forward and rearward ends by end rails 28 and 30. The length of the top frame 18 is preferably substantially greater than the length of the base frame legs 20 for the purposes presently believed apparent.

A pulley plate 32 transversely overlies and projects beyond the sides of the top frame side rail 24 forwardly of the vertical axis of the standard 16. A pulley drive shaft 34 longitudinally overlies the pulley plate and is journalled by bearings 36 secured to the pulley plate. A top pulley 38 is secured to the pulley drive shaft laterally of the top frame.

A variable speed motor M, having a gear train drive, not shown, and a pulley 40 mounted thereon, is mounted on the upper end portion of the standard 16. A V-belt, or the like, 42 is entrained around the pulleys 38 and 40.

A rock shaft 44 transversely overlies the rearward end portion of the frame means 18 and is journalled by bearings 46. A pair of elongated arms 48 are secured, at their respective upper ends, in spaced-apart relation to the rock shaft and extend downwardly therefrom through the frame 18. The depending end portion of the respective arm is angularly inclined forwardly, as at 50, to simulate a rearwardly disposed steer's hock and rear leg configuration terminating in selected spaced relation above the surface of the earth. A relatively short upstanding bar 52 is secured to the rock shaft 44 medially its ends.

A cam plate 54 of selected length is secured at one end to the end of the pulley drive shaft 34 opposite the pulley 38 and is connected at its other end with a connecting rod means 56. The rod means 56 comprises a forward rod 58 pivotally connected at one end with the cam plate 54 and a rearward rod 60 connected at one end with the rocker arm 52 in axial alignment with the rearward end portion of the forward rod 58. A sleeve 62 telescopically receives the adjacent end portion of the forward and rearward rods 58 and 60 for longitudinal adjustment of the connecting rod means 56 by screws 64.

Operation

In operation, with the device assembled, as described hereinabove, and positioned in an outdoor open area the motor M is energized for pivoting the legs 48 in a forward and rearward direction at a selected rate and magnitude of movement simulating the rear legs action of a running steer. A mounted rider approaches or rides past the rearward end portion of the frame 18 and attempts to lasso the legs 48. Since the legs are of uniform construction, the rider may disengage the loop of his rope from the legs by letting it fall by gravity off the legs to repeatedly practice lassoing. Obviously, the rider may practice lassoing the legs with the legs in an immobile position, if desired.

Obviously the invention is susceptible to changes or alterations without defeating its practicability. Therefore, I do not wish to be confined to the preferred embodiment shown in the drawings and described herein.

I claim:

1. An animal rear leg practice roping device for a mounted roper, comprising:

upright open frame means including an elongated elevated top frame portion having forward and rearward ends horizontally supported in cantilever fashion;

pulley drive shaft means transversely overlying the forward end portion of said top frame;

motor means drivably connected with said pulley drive shaft means;

rock shaft means transversely overlying the other end portion of said top frame;

a pair of laterally spaced steer rear leg simulating arms connected with and depending from said rock shaft means; and, rod means connecting said pulley drive shaft means with said rock shaft means for pivoting said leg simulating arms forwardly and rearwardly through an arc of predetermined magnitude.

2. The practice roping device according to claim 1 in which said pulley drive shaft means includes:

an elongated pulley plate projecting laterally of one side of said top frame;

a pulley drive shaft longitudinally overlying said pulley plate;

pulley bearings journalling said pulley drive shaft; and, a cam plate connected with one end of said pulley drive shaft.

3. The practice roping device according to claim 2 in which said motor means comprises:

a motor mounted on said frame; and, belt and pulley means connecting said motor with the other end of said pulley drive shaft.

4. The practice roping device according to claim 3 in which said rock shaft means comprises:

a rock shaft;

rock shaft bearings journalling said rock shaft; and, an upstanding bar secured to said rock shaft medially its ends.

5. The practice roping device according to claim 4 in which said rod means comprises:

a forward rod pivotally connected at one end with said cam plate and projecting rearwardly toward said rock shaft means;

a rearward rod pivotally connected at one end with said upstanding bar and projecting forwardly in axial alignment with said forward rod; and, sleeve means telescopically receiving confronting end portions of said rods.

* * * * *